United States Patent [19]

Van Hook

[11] 4,148,521

[45] Apr. 10, 1979

[54] NOVEL CONVERTIBLE FURNITURE CONSTRUCTION

[76] Inventor: Donald Van Hook, 250 W. 99th St., New York, N.Y. 10025

[21] Appl. No.: 802,663

[22] Filed: Jun. 2, 1977

[51] Int. Cl.[2] ..... A47C 13/00

[52] U.S. Cl. ..... 297/118; 5/344; 297/456

[58] Field of Search ..... 5/344, 337, 352, 357, 5/317 R; 297/118, 456, 221, 457

[56] References Cited

U.S. PATENT DOCUMENTS

| | | | |
|---|---|---|---|
| 1,549,289 | 8/1925 | Bradley | 5/344 |
| 1,985,222 | 12/1934 | Menhall | 297/221 X |
| 2,080,761 | 5/1937 | Crawford | 297/457 |
| 3,466,679 | 9/1969 | Hess | 5/317 R |
| 3,572,836 | 3/1971 | Khanh | 297/456 |
| 3,635,528 | 1/1972 | Strom | 5/365 X |
| 3,641,600 | 2/1972 | Oats | 65/317 R |
| 3,810,263 | 5/1974 | Taylor et al. | 5/317 R |
| 3,813,716 | 6/1974 | Francis | 5/344 |
| 3,822,424 | 7/1974 | Messer | 5/344 |
| 3,974,532 | 8/1976 | Ecchuya | 5/344 X |
| 4,025,973 | 5/1977 | Walbrecht | 5/317 R |
| 4,063,319 | 12/1977 | Smith | 5/343 X |

FOREIGN PATENT DOCUMENTS

| | | | |
|---|---|---|---|
| 516218 | 6/1953 | Belgium | 5/344 |
| 1011600 | 7/1957 | Fed. Rep. of Germany | 5/344 |
| 1021146 | 12/1957 | Fed. Rep. of Germany | 5/344 |
| 1034337 | 7/1958 | Fed. Rep. of Germany | 5/344 |
| 418372 | 10/1934 | United Kingdom | 5/344 |

*Primary Examiner*—James T. McCall
*Attorney, Agent, or Firm*—Auslander & Thomas

[57] ABSTRACT

A spindle and web configuration of furniture is adaptable to a variety of furniture configurations.

8 Claims, 11 Drawing Figures

NOVEL CONVERTIBLE FURNITURE CONSTRUCTION

The present invention relates to a novel convertible furniture construction.

The present invention comprises a basic spindle and web whose configuration may be adapted to a number of selected furniture configurations.

Convertibility of furniture, such as from a seat to a bed is well known in the art and has been achieved by many means such as conventional mechanical linkages or even by refoldable cushions, such as disclosed in U.S. Pat. No. 3,742,526. Multipurpose furniture providing a multitude of seating and reclining choices are old in the art, such as found in the articulated structure disclosed in U.S. Pat. No. 2,843,181.

The present invention, using the combination of a web and a spindle provides a convertible furniture construction that can serve as chaise, as recliner, a chair, a backrest or even a bed.

Although such novel feature or features believed to be characteristic of the invention are pointed out in the claims, the invention and the manner in which it may be carried out, may be further understood by reference to the description following and the accompanying drawings.

Figure 10:
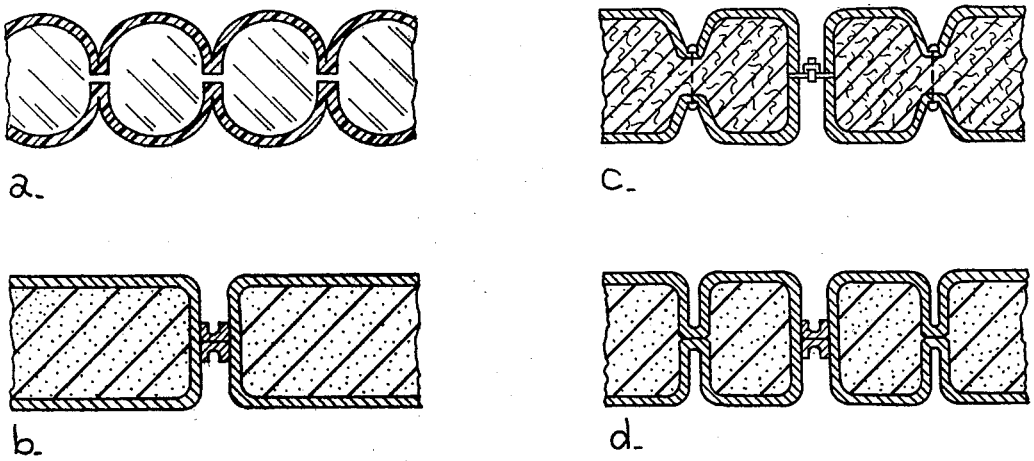

FIGS. 10 *a–d* are details of optional web configuration.

Figure 11:
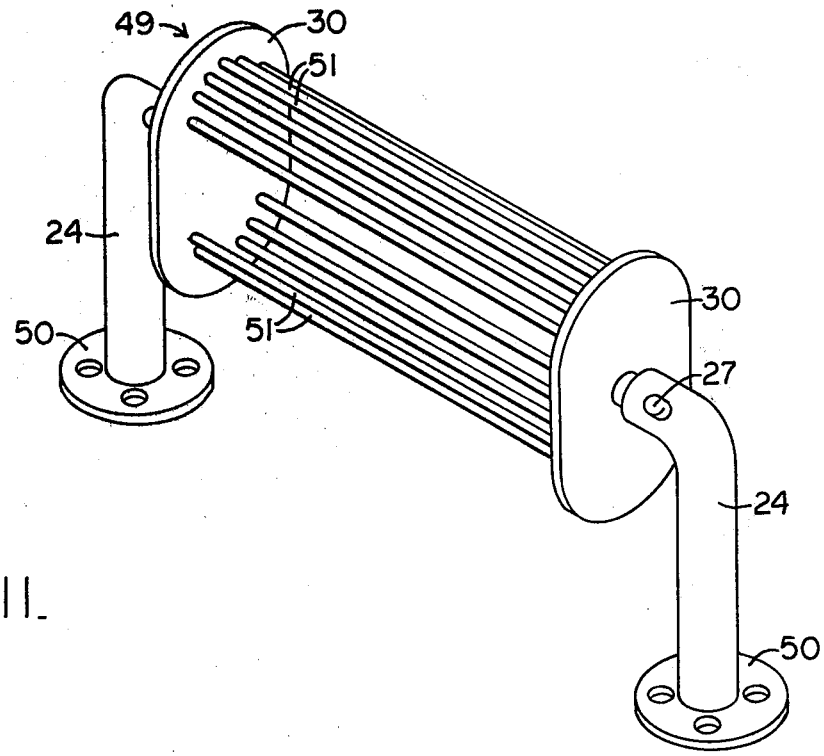

FIG. 11 is an alternate spindle of the present invention.

Referring now to the figures in greater detail, where like reference numbers denote like parts in the various figures.

Figure 1:
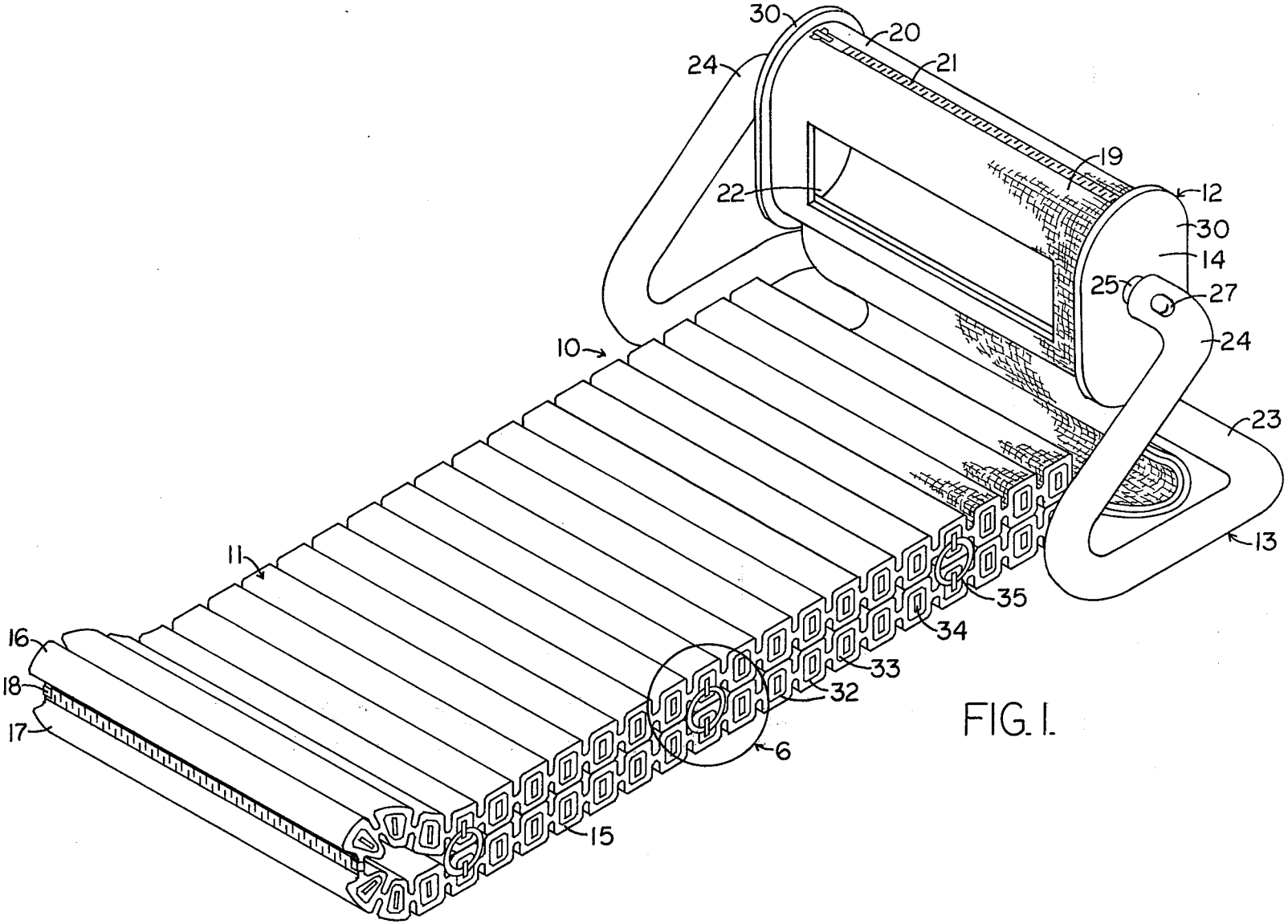
FIG. 1 is an isometric view of the present invention as a chaise.
Figure 2:
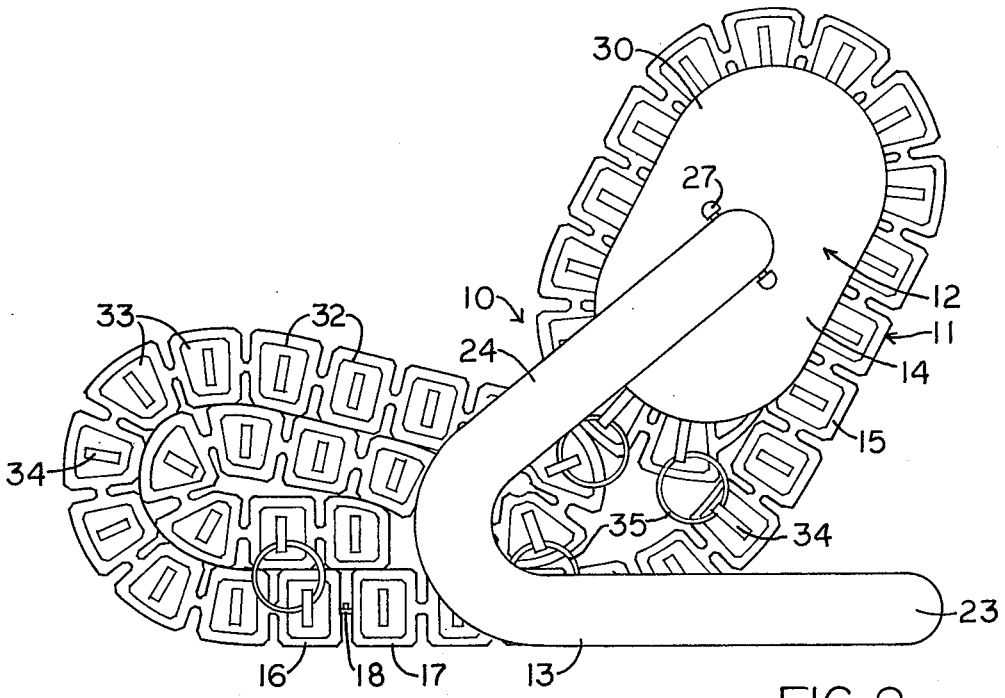
FIG. 2 is a side elevation of the convertible of FIG. 1 in the form of a chair.
Figure 3:
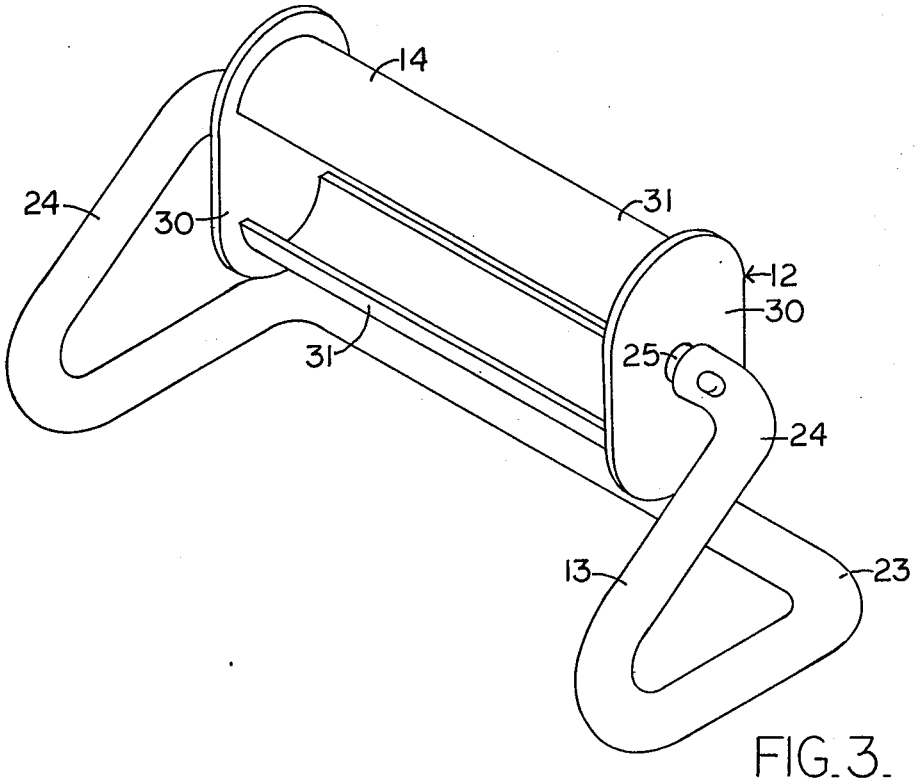
FIG. 3 is a detail of a spindle and base of the present invention.

The convertible furniture construction 10 comprises two basic units, a web 11 and a support structure 12, as can be seen in FIGS. 1–3.

The support structure 12 comprises a stanchion 13 and a spindle 14. The web 11 as shown in FIGS. 1 and 2 is preferably contiguous though it may include separable portions. One section comprises a bulk support sheath 15. The bulk support sheath 15 may be separable into more than one section 16, 17 joined by a separable stringer zipper 18. Integral to the bulk support sheath 15 is spindle web 19 which includes a sheath 20 attachable about the spindle 14. The spindle sheath 20 includes a closure 21 which is preferably a separable stringer zipper. The sheath 20 may include an opening 22, giving access to the inside of the spindle 14.

Figure 4:
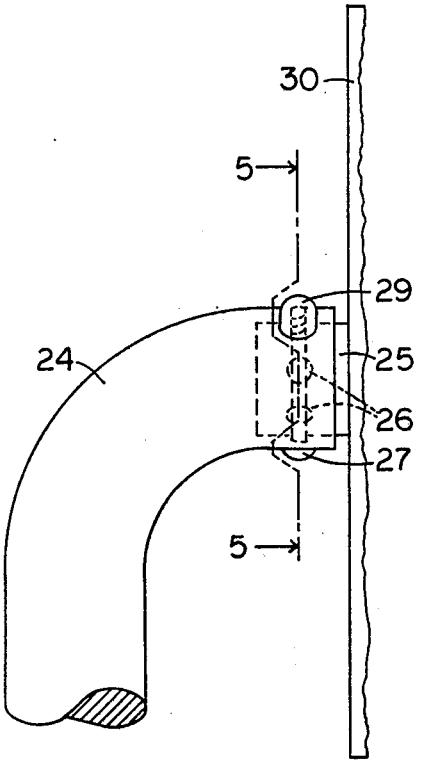
FIG. 4 is a detail of the joints between the spindle of the present invention and its support.
Figure 5:
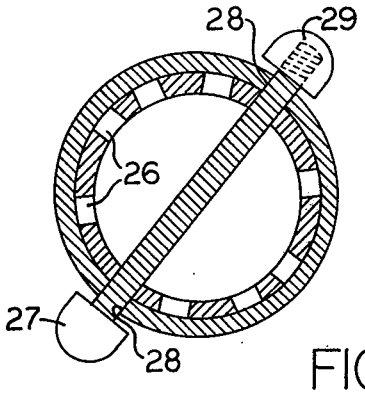
FIG. 5 is a section of FIG. 4 on lines 5 — 5.
Figure 7:
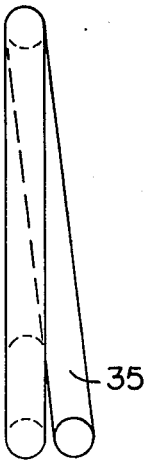
FIG. 7 is a side elevation of a joining ring of FIG. 6.

The support structure 12 includes a stanchion 13 configured to form a base 23 and spindle support arms 24. The arms 24 are preferably hollow as can be seen in FIG. 4 and adapted to receive the spindle shafts 25. The spindle shafts 25 include diametric spaced openings 26, as shown in FIGS. 4 and 5, through which pins 27 passing through openings 28 in th spindle arms 24 may position the spindle 24 on the shafts 25 fastened with screw heads 29 as shown in FIG. 5.

The spindle 14 itself, as shown in FIG. 3, is preferably hollow and comprises a pair of elongated sides 30 in the form of end plates and a pair of cross braces 31.

Figure 8:
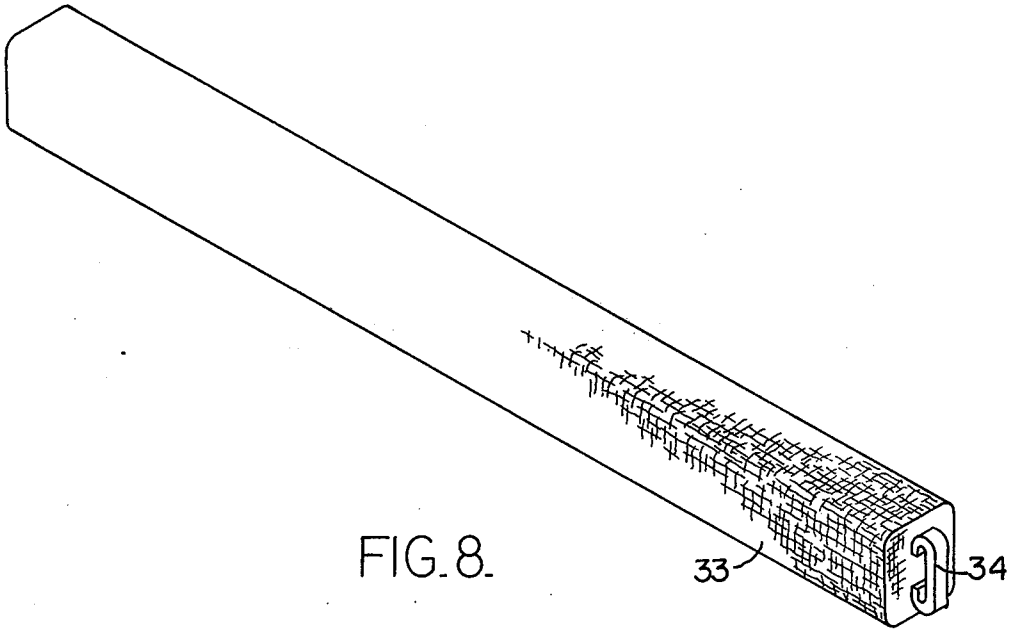
FIG. 8 is an isometric view of a bolster of FIGS. 1, 2 and 6.

The bulk support sheath 15, as shown in FIGS. 1 and 2, preferably comprises a series of contiguous pockets 32 adapted to receive cushioned bolsters 33 as can be seen in FIG. 8. The bolsters 33 may be stuffed with conventional stuffing or include foam rubber or plastic as desired.

As seen in FIG. 8, the bolster 33 includes grasps 34 for convenient insertion and removal from the pockets 32. The grasps 34 also serve another important function as can be seen in FIGS. 1 and 2 and in the detail of FIG. 6 where the grasps 34 are joined by rings 35 to interhold the bulk support sheath 15 in a desired position.

Figure 9:
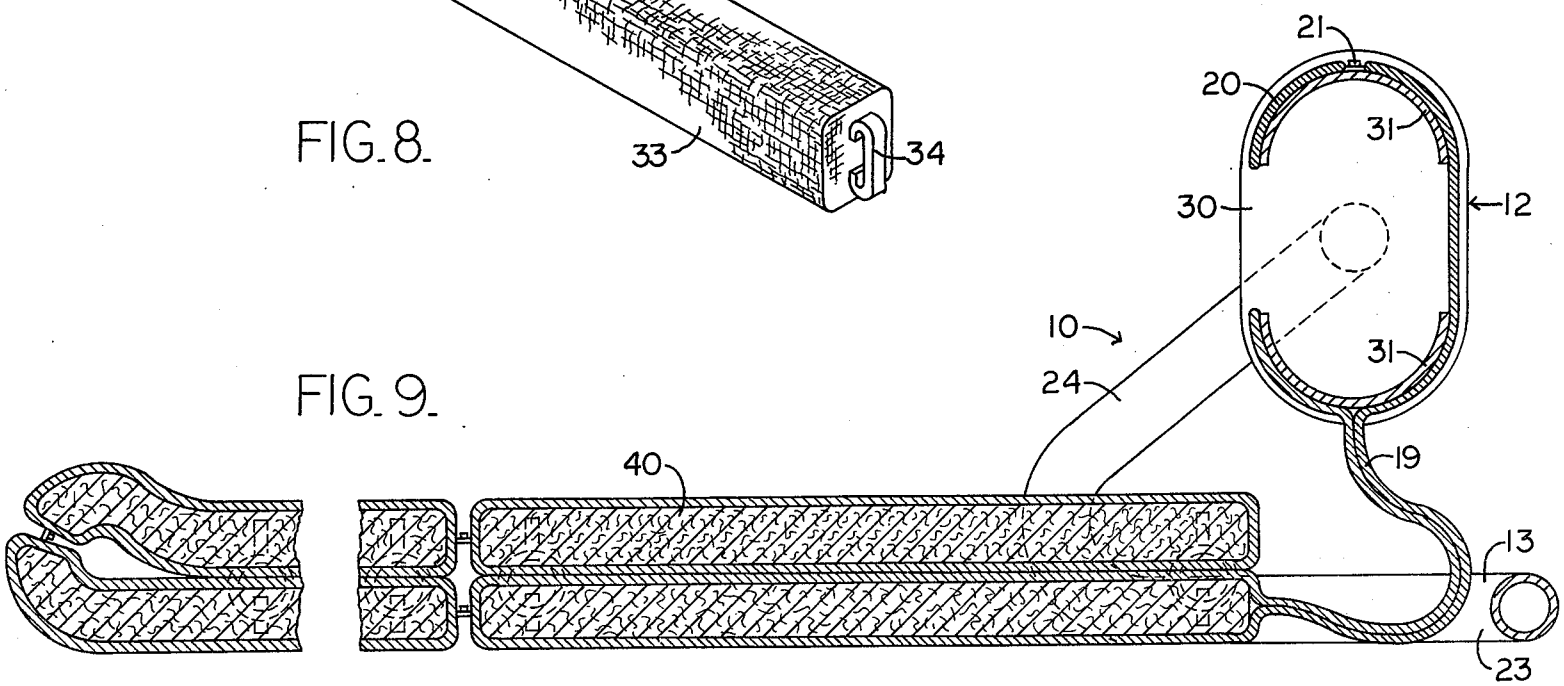
FIG. 9 is a section of the present invention showing an alternate web configuration.

In FIG. 9, a detail section of an alternate bulk support sheath 40 may be in the form of a thin upholstered mattress. While this is not the preferred embodiment, it has the advantage of simple construction. Alternate option bulk supports are shown in section in FIGS. 10 *a–d*. FIG. 10*a* represents a section of an inflatable bulk support section such as may be found in an air mattress. FIG. 10*b* shows a foam rubber upholstery as an alternative to the construction of the bulk support 40 in FIG. 9. FIG. 10*c* is a detail of a quilted bulk support showing joined sections. FIG. 10*d* shows a stuffed bulk support similar to the bulk support of FIGS. 1 and 2 with integral foam rubber stuffing instead of the removable bolsters 33.

In FIG. 11 it shows an alternate spindle of the present invention including anchors 50 which support the spindle supports arms 24 and which may permanently be anchored, such as into a floor. The cross bracing is an alternate structure of doweling 51.

In use the form of the convertible furniture construction is selected, such as the chaise longue, as shown in FIG. 1. The spindle 14 is arranged in position on the shafts 25 with the pins 27 set through the openings 26, 28 in the spindle support arms 24 and the shafts 25. The sheath 20 may usually be left in position. The removability of the sheath 20 and of the bolsters 33 from the bulk support sheath allow for cleaning and servicing of the web 11.

The hollow of the spindle 14 with the opening 22 in the sheath 20 enables the spindle 14 to be used for storage of small pillows or any selected articles.

Figure 6:
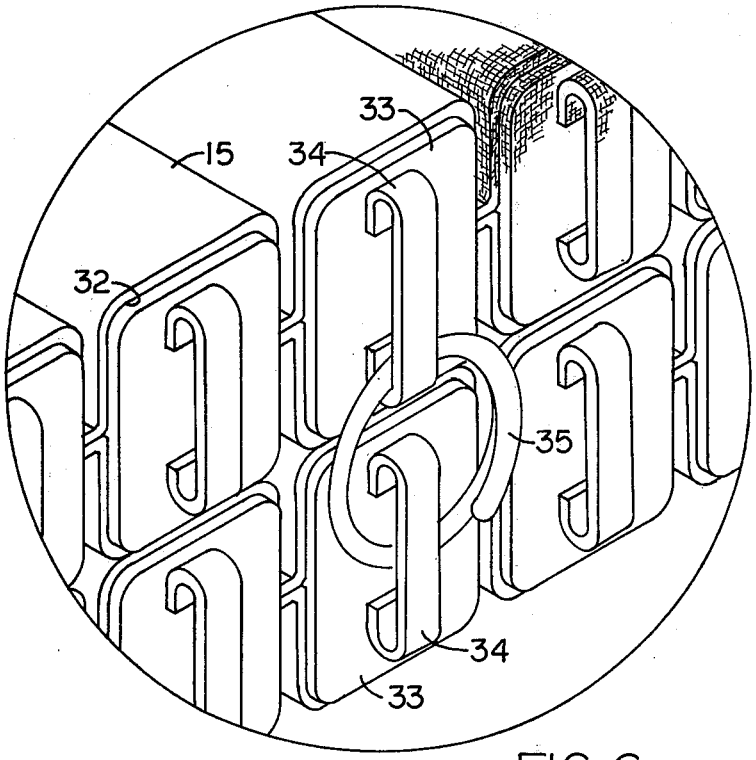
FIG. 6 is an enlarged detail of FIG. 1 showing a method of joining a web portion.

For use as a chaise, the sections 16, 17 of the bulk support sheath 15 are folded over each other. The bolster grasps 34 are then interheld by the rings 35 as shown in FIG. 6 to provide stability to the configuration.

When a chair is desired, as shown in FIG. 2, the web 11, including part of the bulk support sheath 15 is wound about the spindle 14 bulking the spindle as a back support. The balance of the web 11 is overfolded and bulked as a seat portion as shown. The back portion and seat portions are then anchored in position by joining the appropriate grasps 34 by the rings 35.

For convenience, the spindle sheath 20 and bulk support sheaths includes stringer separable zippers 18, 21. Other forms of closures such as buttons or Velcro might equally serve the same function of joining the parts of the web 11 together.

The spindle 14 and stanchion 13 is preferably fabricated of metal, although they might easily be mass produced from molded plastic.

The spindle 49 as shown in FIG. 11 is an alternate construction which may be made of wood and wooden dowel 51, cast or injected plastic or of metal. The spindle 49 is anchored to the floor through anchors 50 and used in the same manner as the other embodiments of the present invention.

For cheaper construction of the convertible furniture of the present invention, a sheath 40 in large upholstered sections may be employed as shown in FIG. 9 or alternate bulk supports of the simple construction shown in FIGS. 10 *a–d* may constitute the web 11 and its bulk support construction.

The convertible furniture construction 10 of the present invention may have the entire web 11 wrapped about the spindle 14 (not shown) for storage or to serve as a backrest which may even be used on a bed. The storage or backrest configuration bulks to the same configuration with the structures of FIGS. 10 *a–d*. In the air mattress construction of FIG. 10*a* though, the air mattress may further be debulked by deflation. In the air mattress construction of FIG. 10*a*, the zipper or other fastening means to join the sections of the bulk support sheath are, of course, optional.

The pin 27 and screwhead construction is an exemplary configuration for positioning the spindle 14 of the present invention. It is contemplated that other means known in the art might also be employed.

The web 11 including the bulk support sheath 15, when wrapped on the spindle 14, preferably does not extend to the floor beneath the stanchion 13. Extended as a chaise, the web 11 folded over, as shown in FIG. 1, extends approximately to six or seven feet long with a total thickness of six inches to a foot. As a chair, the overfolded front portion in a preferred embodiment is about seventeen inches off the floor with the backrest reclining approximately 28° and an approximately seventeen inch seat portion.

While grasps 34 and rings 35 have been disclosed in the figures, it is contemplated that means such as straps and snap fasteners or other means known in the art may be used to hold the bulk support sheath 15 in position in its various use configurations.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A construction for a piece of furniture convertible into sleeping or resting or sitting positions comprising a web and a web support structure, said web support structure including a spindle, said spindle including a pair of elongated sides and means to cross brace said sides, said cross bracing means along the length of said sides, said spindle adapted to receive said web thereabout, said support structure including a stanchion, said stanchion including means to support itself and means to support said spindle in fixed position, means to select other fixed positions of said spindle with regard to said spindle support means, said web including a portion attachable to said spindle, said web including a sheath portion, said sheath portion including means to support bulk, and said web including means to interhold selected portions of said web in selected positions.

2. The invention of claim 1 wherein said interholding means include grasps and ring.

3. The invention of claim 1 wherein said sheath portion includes a plurality of pockets.

4. The invention of claim 3 including a plurality of bolsters adapted to fit in said pockets.

5. The invention of claim 3 wherein said pockets are upholstered.

6. The invention of claim 1 wherein said sheath portion is upholstered.

7. The invention of claim 1 wherein said sheath portion is inflatable.

8. The invention of claim 1 wherein said stanchion includes anchor means, said anchor means adapted to be affixed to a surface.

* * * * *